US010838334B2

(12) United States Patent
Sakai et al.

(10) Patent No.: US 10,838,334 B2
(45) Date of Patent: Nov. 17, 2020

(54) FIXING DEVICE AND IMAGE FORMING APPARATUS

(71) Applicant: KYOCERA Document Solutions Inc., Osaka (JP)

(72) Inventors: Yuhiro Sakai, Osaka (JP); Masakazu Uehara, Osaka (JP); Hironori Takahashi, Osaka (JP); Tomohiro Watatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/716,147

(22) Filed: Dec. 16, 2019

(65) Prior Publication Data

US 2020/0201220 A1 Jun. 25, 2020

(30) Foreign Application Priority Data

Dec. 21, 2018 (JP) ..... 2018-239766

(51) Int. Cl.
*G03G 15/20* (2006.01)
*G03G 15/00* (2006.01)

(52) U.S. Cl.
CPC ..... *G03G 15/2053* (2013.01); *G03G 15/2042* (2013.01); *G03G 15/2064* (2013.01); *G03G 15/5004* (2013.01); *G03G 2215/2035* (2013.01)

(58) Field of Classification Search
CPC ..... G03G 15/2042; G03G 15/2053; G03G 15/2064; G03G 15/5004; G03G 21/1685; G03G 2215/2016; G03G 2215/2035
See application file for complete search history.

(56) References Cited

U.S. PATENT DOCUMENTS

2018/0024480 A1* 1/2018 Fujita ..... G03G 15/2053 399/33 X
2019/0339638 A1* 11/2019 Kinukawa ..... G03G 15/2064

FOREIGN PATENT DOCUMENTS

JP 2017097143 A 6/2017

* cited by examiner

*Primary Examiner* — Sophia S Chen
(74) *Attorney, Agent, or Firm* — Studebaker & Brackett PC

(57) ABSTRACT

A fixing device includes a fixing belt and a heating section. The heating section is disposed opposite to an inner circumferential surface of the fixing belt. The heating section includes a heater, a heater holding member, and a pinching member. The heater heats the fixing belt. The heater holding member holds the heater. The pinching member pinches the heater and the heater holding member to restrict movement of the heater relative to the heater holding member.

10 Claims, 11 Drawing Sheets

FIXING DEVICE AND IMAGE FORMING APPARATUS

INCORPORATION BY REFERENCE

The present application claims priority under 35 U.S.C. § 119 to Japanese Patent Application No. 2018-239766, filed on Dec. 21, 2018. The contents of this application are incorporated herein by reference in their entirety.

BACKGROUND

The present disclosure relates to a fixing device and an image forming apparatus.

Fixing devices using a heating film have been known to be included in an electrographic image forming apparatus. A fixing device such as above includes a fixing assembly and a pressure roller that presses against the fixing assembly to form a fixing nip part. The fixing assembly includes a tubular fixing film, a heater in contact with an inner surface of the fixing film, a heat insulating holder that holds the heater, a metal stay that presses the heat insulating holder against the pressure roller, a thermistor, and a thermal conduction member. The thermistor is provided on the heat insulating holder and in contact with the thermal conduction member at a specific pressure through a through hole in the heat insulating holder. The thermal transmission member is held by the heat insulating holder between the heater and the heat insulating holder.

SUMMARY

A fixing device according to an aspect of the present disclosure includes a fixing belt and a heating section. The heating section is disposed opposite to an inner circumferential surface of the fixing belt. The heating section includes a heater, a heater holding member, and a pinching member. The heater heats the fixing belt. The heater holding member holds the heater. The pinching member pinches the heater and the heater holding member to restrict movement of the heater relative to the heater holding member.

According to another aspect of the present disclosure, an image forming apparatus includes the above-described fixing device and an image forming section. The image forming section forms a toner image on a sheet. The fixing device fixes the toner image to the sheet.

DETAILED DESCRIPTION

Figure 1:
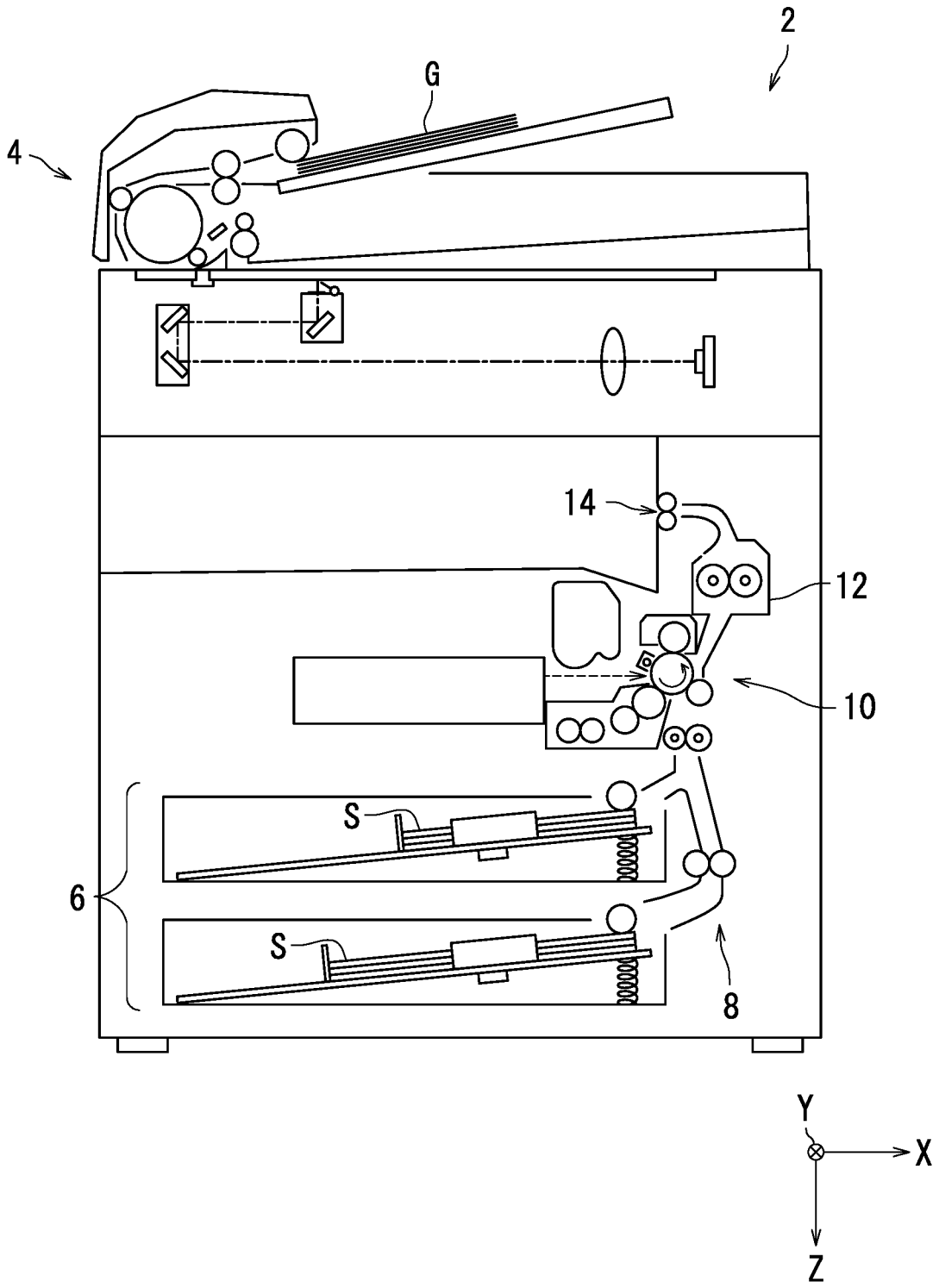
FIG. 1 is a diagram illustrating an image forming apparatus including a fixing device according to an embodiment of the present disclosure.

The following describes embodiments of the present disclosure with reference to the accompanying drawings. Elements that are the same or equivalent are indicated by the same reference signs in the drawings, and description thereof is not repeated. In a three-dimensional rectangular coordinate system in the following embodiments, an X axis and a Y axis are parallel to a horizontal plane and a Z axis is parallel to a vertical direction. A direction of the Y axis is an example of a direction parallel to a "rotation axis" of a "pressure member" in the present disclosure.

Operation and configuration of an image forming apparatus 2 including a fixing device 12 will be described with reference to FIG. 1. FIG. 1 is a diagram illustrating the image forming apparatus 2 including the fixing device 12 according to an embodiment of the present disclosure. The image forming apparatus 2 is for example a copier, a printer, a facsimile machine, or a multifunction peripheral that implements functions of the aforementioned machines.

As illustrated in FIG. 1, the image forming apparatus 2 includes a reading section 4, a feeding section 6, a conveyance section 8, an image forming section 10, the fixing device 12, and an ejection section 14.

The reading section 4 reads an image of a document G. The reading section 4 generates image data based on the read image. The feeding section 6 accommodates a plurality of sheets S and feeds the sheets S to the conveyance section 8 one at a time. Each of the sheets S is for example a sheet of paper or a sheet made from a synthetic resin. The conveyance section 8 includes a plurality of conveyance roller pairs and conveys the sheet S to the image forming section 10.

The image forming section 10 electrographically forms a toner image on the sheet S in the present embodiment. Specifically, the image forming section 10 includes a photosensitive drum, a charger, a light exposure device, a development device, a replenishment device, a transfer device, a cleaner, and a static eliminator.

The fixing device 12 fixes the toner image to the sheet S by applying heat and pressure to the toner image. The conveyance section 8 conveys the sheet S with the toner image fixed thereto to the ejection section 14. The ejection section 14 ejects the sheet S out of the image forming apparatus 2.

Figure 2:
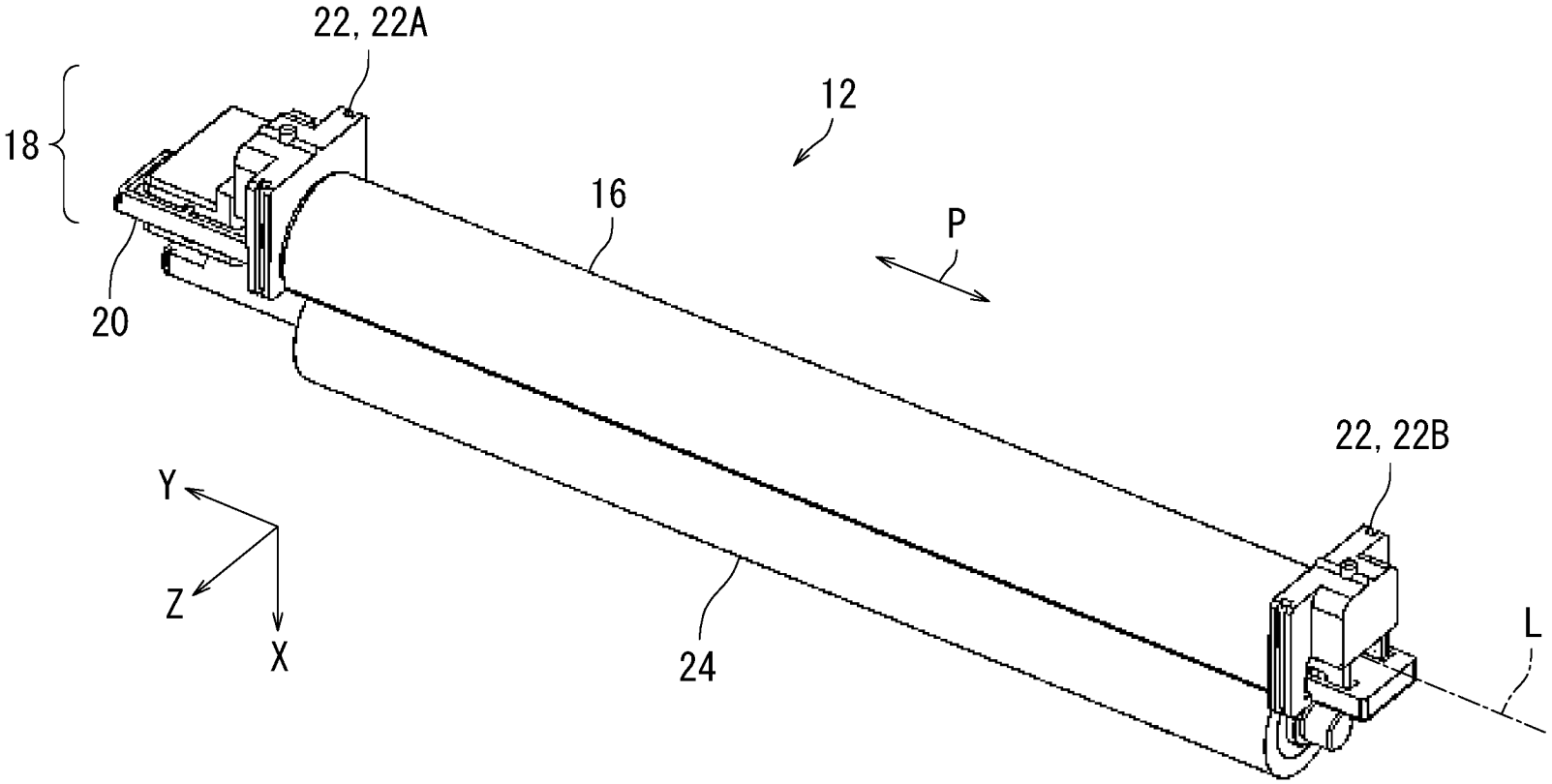
FIG. 2 is a perspective view of the fixing device according to the embodiment as viewed from diagonally above.

The fixing device 12 will be described next with reference to FIG. 2. FIG. 2 is a perspective view of the fixing device 12 according to the present embodiment as viewed from diagonally above.

As illustrated in FIG. 2, the fixing device 12 includes a fixing belt 16, a heating section 18, a pair of holding members 22, a pressure member 24, and an unillustrated drive mechanism.

The fixing belt 16 is a flexible endless belt in a substantially tubular shape. Following rotation of the pressure member 24, the fixing belt 16 rotates about a rotation axis L of the fixing belt 16. The fixing belt 16 includes a plurality of layers. The fixing belt 16 includes for example a polyimide layer and a release layer disposed on the polyimide layer. The release layer is for example a heat-resistant film made from a fluororesin.

The heating section 18 extends in a direction parallel to the rotation axis L of the fixing belt 16. The heating section 18 is disposed opposite to an inner circumferential surface of the fixing belt 16. The heating section 18 will be described later in detail.

The pressure member 24 is disposed on the fixing belt 16 in a separable and contactable manner. A nip part is formed at a location where the pressure member 24 is in pressure contact with the fixing belt 16. When the pressure member 24 is driven and rotate, the fixing belt 16 follows the rotation of the pressure member 24 to be rotated. When the sheet S passes through the nip part through conveyance of the sheet S in a sheet conveyance direction, the toner image is melted and fixed to the sheet S. The pressure member 24 is for example a pressure roller in a columnar shape.

In the following description, one of the pair of holding members 22 may be referred to as a holding member 22A and the other thereof may be referred to as a holding member 22B. The holding member 22A holds one end of opposite ends of the fixing belt 16 in a slidable manner. The holding member 22B holds the other end of the fixing belt 16 in a slidable manner.

The unillustrated drive mechanism drives and rotates the pressure member 24. The drive mechanism includes for example a drive motor and a gear. The drive mechanism is connected to one of opposite ends of a rotation shaft of the pressure member 24.

Figure 3:
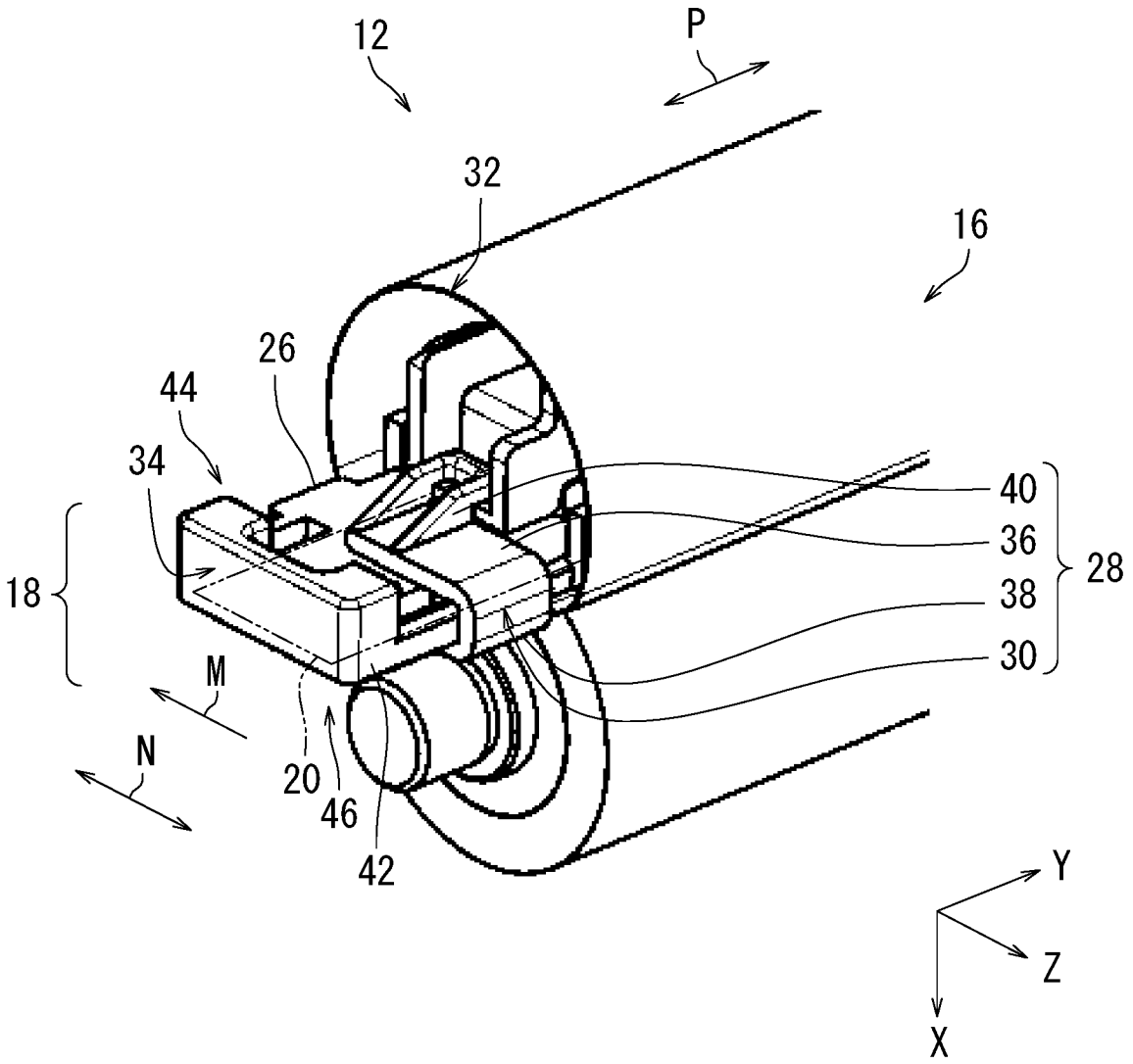
FIG. 3 is a perspective view of the fixing device and a heating section according to the embodiment as viewed from diagonally above.

The fixing device 12 and the heating section 18 will be described with further reference to FIG. 3 in addition to FIG. 2. FIG. 3 is a perspective view of the fixing device 12 and the heating section 18 according to the present embodiment as viewed from diagonally above. FIG. 3 is an external view of a state in which the holding members 22 are removed from the fixing device 12 in FIG. 2 to expose a part of the heating section 18.

As illustrated in FIG. 3, the heating section 18 includes a heater 20, a heater holding member 26, and at least one pinching member 28.

The heater 20 is a heating element having a planar or thin and long plate shape, and heats the fixing belt 16. The heater 20 extends in a direction parallel to the rotation axis L of the fixing belt 16. In the present embodiment, the rotation axis L of the fixing belt 16 is substantially parallel to a rotation axis of the pressure member 24. The heater 20 is for example a ceramic heater and includes a ceramic substrate and a resistance heating element. The heater 20 has a thickness of 1 mm, for example.

The heater holding member 26 extends in a specific direction (also referred to below as a "longitudinal direction P"). Preferably, the longitudinal direction P is a direction parallel to the rotation axis L of the fixing belt 16, that is, parallel to a longitudinal direction of the heater 20. The definition of the longitudinal direction P may apply throughout the description of the present disclosure.

The heater holding member 26 is disposed opposite to the heater 20 or in contact with the heater 20 to hold the heater 20. A plurality of ribs are provided on a surface of the heater holding member 26 located on a side opposite to the heater 20.

The pinching member 28 pinches the heater 20 and the heater holding member 26 to restrict movement of the heater 20 relative to the heater holding member 26. In the above configuration in the present embodiment, it is possible to prevent the heater 20 from detaching from the heater holding member 26. The heater 20 may be subjected to application of oil such a grease. With the pinching member 28, it is possible to prevent oil from flowing to an electric terminal of the image forming apparatus 2. In particular in an embodiment, the pinching member 28 pinches one end of the heater 20 in the longitudinal direction P and a corresponding one end of the heater holding member 26 in the longitudinal direction P to restrict movement of the heater 20 relative to the heater holding member 26. The pinching member 28 includes a first pinching portion 36, a second pinching portion 38, a third pinching portion 40, and a joint portion 30.

The heater holding member 26 has an upper surface 44 and a lower surface 46. The heater 20 is disposed below the lower surface 46 of the heater holding member 26. The first pinching portion 36 of the pinching member 28 is in contact with the heater holding member 26 on an opposite side of the heater holding member 26 to the heater 20. Specifically, the first pinching portion 36 is located on and in contact with the upper surface 44 of the heater holding member 26. The second pinching portion 38 is in contact with the heater 20 underneath the heater 20. Specifically, the second pinching portion 38 is located below the lower surface 46 of the heater holding member 26 and is in contact with the heater 20 disposed underneath the lower surface 46 of the heater holding member 26. The joint portion 30 connects the first pinching portion 36 to the second pinching portion 38. The joint portion 30 functions as a positioning member or a stopper for positioning the heater 20 relative to the heater holding member 26 in a state in which the pinching member 28 is attached to the heater 20 and the heater holding member 26.

The pinching member 28 is shaped into a substantial U shape with the joint portion 30, the first pinching portion 36, and the second pinching portion 38. The third pinching portion 40 extends from the first pinching portion 36 in the longitudinal direction P toward a heat sensitive body holding portion 62 which will be described later. The third pinching portion 40 is in a claw-like shape or a hook-like shape extending toward the heat sensitive body holding portion 62. The joint portion 30, the first pinching portion 36, the second pinching portion 38, and the third pinching portion 40 may be integral or joined together.

The heater holding member 26 has a rim 42 extending in the longitudinal direction P. The pinching member 28 pinches the heater 20 and the heater holding member 26 from a side of the rim 42 of the heater holding member 26. In the above configuration in the present embodiment, the pinching member 28 can be attached to the heater 20 and the heater holding member 26 from the side of the rim 42 of the heater holding member 26. Thus, it is possible to easily make the pinching member 28 pinch the heater 20 and the heater holding member 26. Specifically, the pinching member 28 pinches the heater 20 and the heater holding member 26 by being attached to the heater 20 and the heater holding member 26 in a direction M from the side of the rim 42 of the heater holding member 26.

The direction M is a direction parallel to a short direction N of the heater 20 or the heater holding member 26. In the present embodiment, the direction M is a sheet conveyance direction in which the sheet S passes through the nip part between the fixing belt 16 and the pressure member 24. The definition of the direction M may apply throughout the description of the present disclosure.

The heater 20 is pinched by the pinching member 28 in a state of being held by the heater holding member 26. Thus, the heater 20 is difficult to detach from the heater holding member 26. Accordingly, it is possible to prevent the heater 20 from falling off of the heater holding member 26. Furthermore, once a user attaches the heater 20 onto the heater holding member 26, the heater 20 is difficult to detach from the heater holding member 26 in the short direction N. Thus, it is possible to prevent the heater 20 from falling off of the heater holding member 26.

The pinching member 28 pinching the heater 20 and the heater holding member 26 is moveable in the longitudinal direction P toward the heater holding member 26. As a result of the pinching member 28 moving in the longitudinal direction P, the third pinching portion 40 of the pinching member 28 holds the later-described heat sensitive body holding portion 62.

When mounted on the heater holding member 26, the holding member 22A in FIG. 2 holds a first end 32, which is one of the opposite ends of the fixing belt 16, in a slidable manner while holding a first end 34, which is one of opposite ends of the heater holding member 26. The holding members 22 will be described later.

Figure 4:
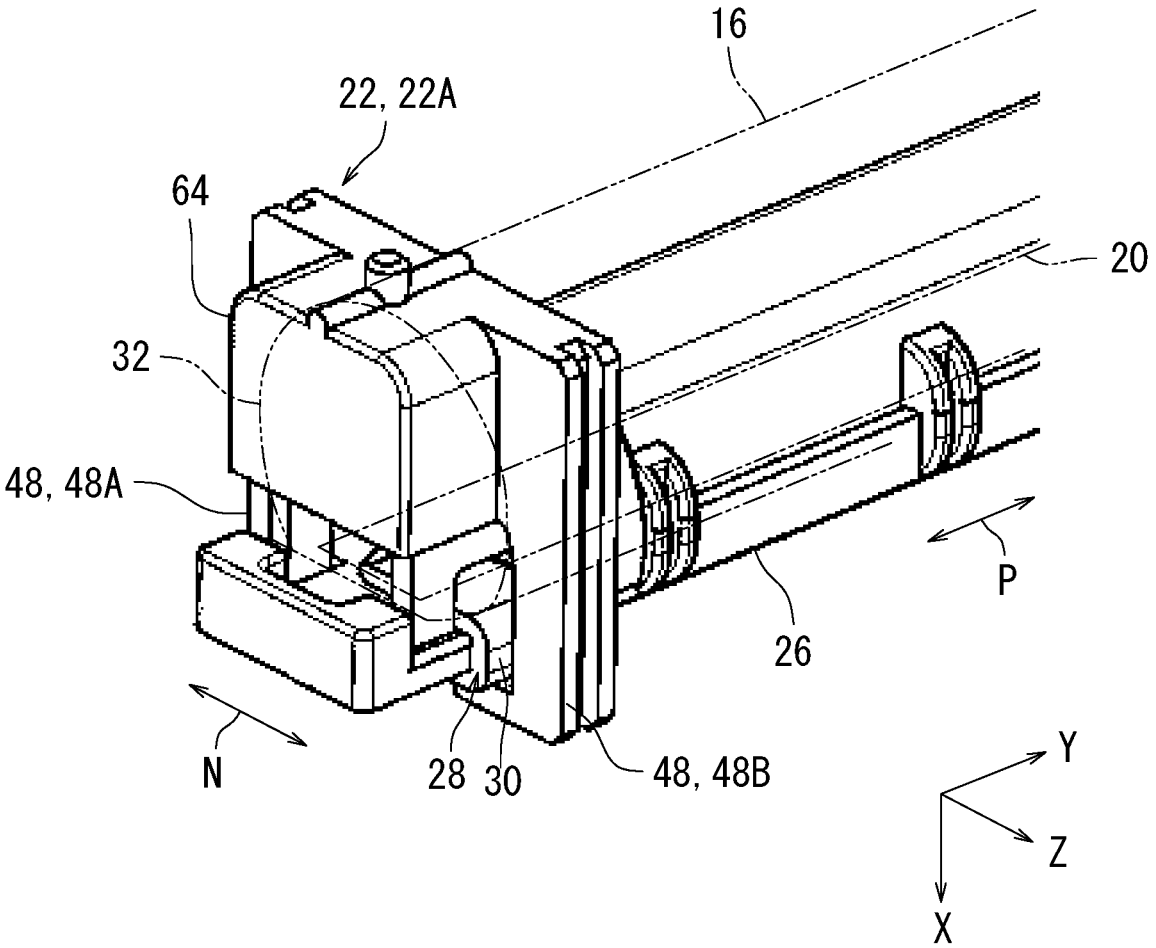
FIG. 4 is another perspective view of the fixing device according to the embodiment as viewed from diagonally above.
Figure 5:
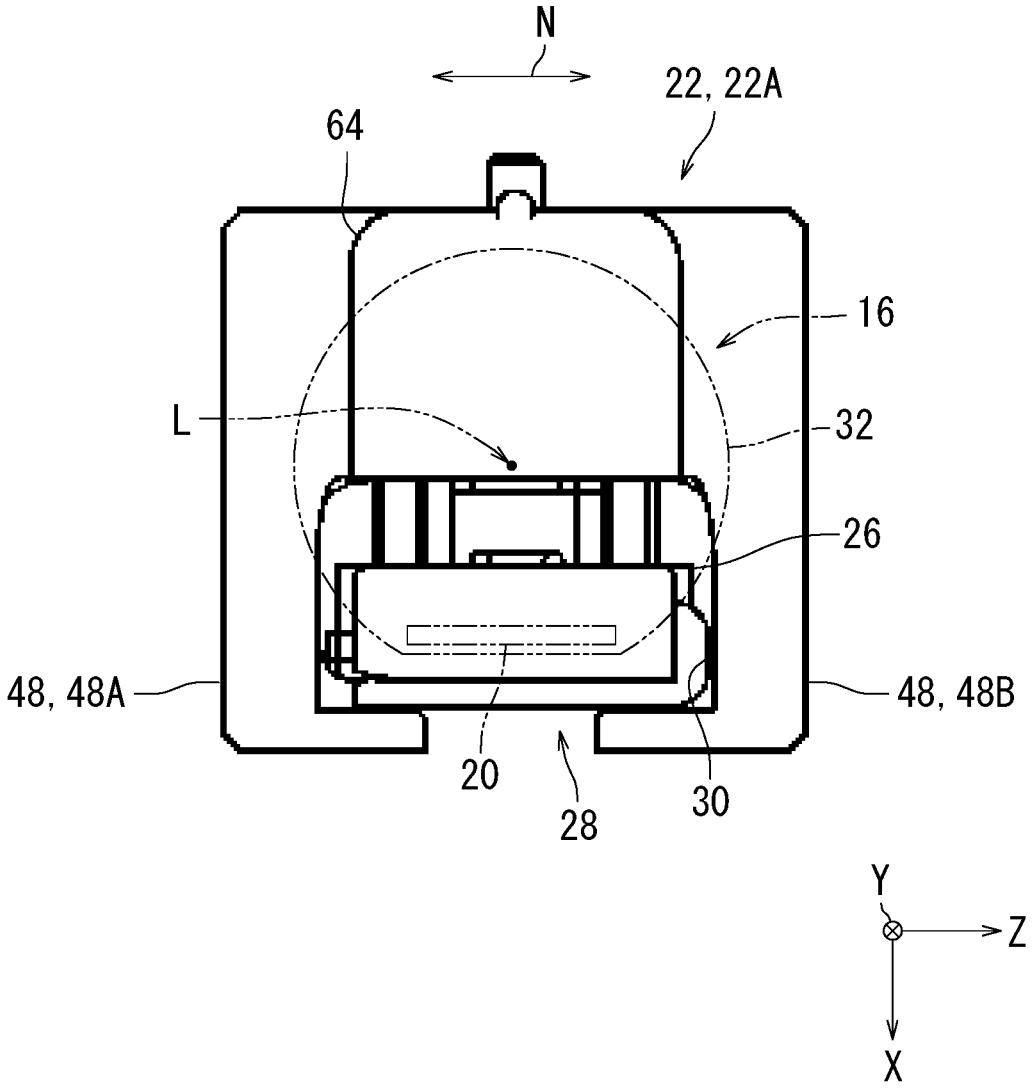
FIG. 5 is an external view of the fixing device according to the embodiment as viewed in a direction of a rotation axis of a fixing belt of the fixing device.

The fixing device 12 and the heating section 18 will be described next with reference to FIGS. 4 and 5. FIG. 4 is a perspective view of the fixing device 12 according to the present embodiment as viewed from diagonally above. FIG. 5 is an external view of the fixing device 12 according to the present embodiment as viewed in a direction of a rotation axis L of the fixing belt 16.

As illustrated in FIG. 4, each of the holding members 22 includes a body portion 64 and two first restricting portions 48 each in a hook-like shape. The body portion 64 forms unillustrated accommodation space therein on a side facing the fixing belt 16. The accommodation space holds the first end 32 of the fixing belt 16 in a slidable manner.

In the following description, one of the first restricting portions 48 may be referred to as a first restricting portion 48A, and the other of the first restricting portions 48 may be referred to as a first restricting portion 48B. The first restricting portion 48A and the first restricting portion 48B extend in a hook-like shape under the lower surface 46 of the heater holding member 26 from respective opposite sides of the body portion 64 of the holding member 22 until the heater 20. The first restricting portion 48A and the first restricting portion 48B catches and holds the first end 32 of the heater 20, the first end 34 of the heater holding member 26, and the pinching member 28.

As illustrated in FIGS. 4 and 5, the joint portion 30 of the pinching member 28 is in contact with an inside surface of the first restricting portion 48B of the holding member 22. In the above configuration, the first restricting portion 48B of the holding member 22 restricts movement of the pinching member 28 in the short direction N of the heater 20 relative to the heater 20 and the heater holding member 26. Accordingly, the pinching member 28 is difficult to detach from the heater 20 and the heater holding member 26, thereby preventing the pinching member 28 from falling off of the heater 20 and the heater holding member 26. Thus, it is particularly possible to prevent the heater 20 from detaching from the heater holding member 26 in the short direction N once the holding member 22 is mounted on the heater holding member 26.

Figure 6:
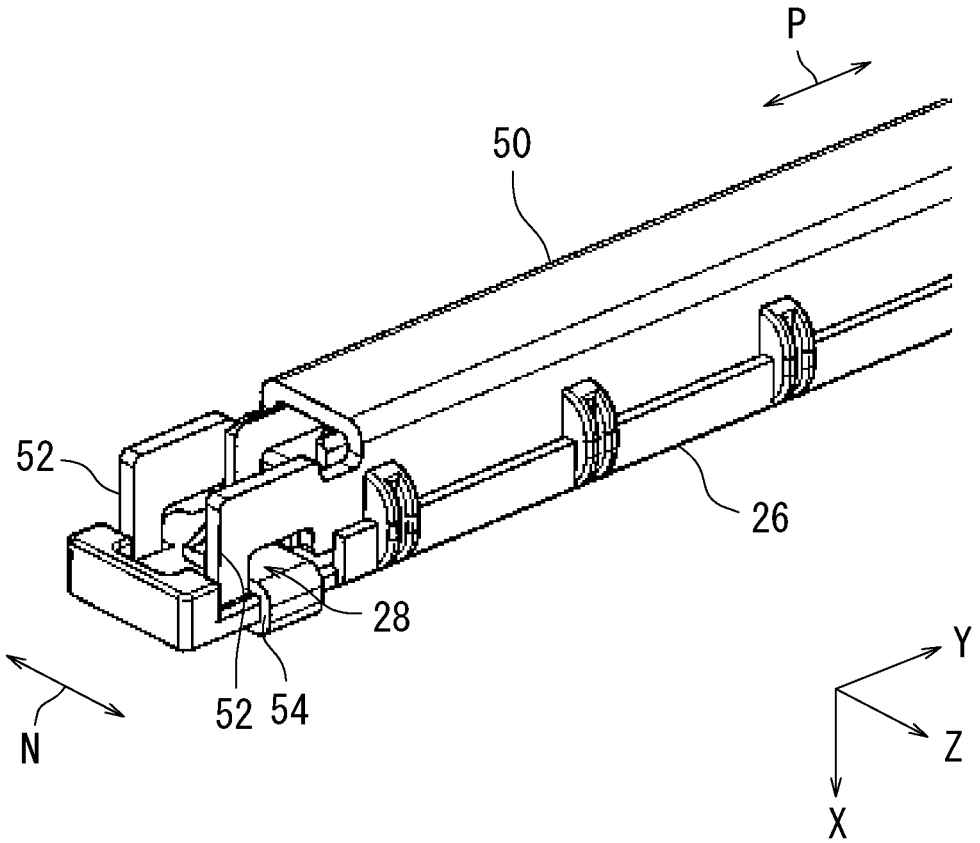
FIG. 6 is a perspective view of a reinforcing member according to the embodiment as viewed from diagonally above.

The following describes a reinforcing member 50 with further reference to FIG. 6 in addition to FIGS. 4 and 5. FIG. 6 is a perspective view of the reinforcing member 50 according to the present embodiment as viewed from diagonally above. The heating section 18 further includes the reinforcing member 50. The reinforcing member 50 is disposed opposite to the heater holding member 26, and reinforces the heater holding member 26.

The reinforcing member 50 is for example a long and slim metal stay member extending in parallel to the rotation axis L of the fixing belt 16. The reinforcing member 50 is substantially in an inverted U-shape in cross section as viewed in the direction of the rotation axis L.

The reinforcing member 50 is overlaid in the longitudinal direction P with the heater holding member 26 and held by the heater holding member 26.

The reinforcing member 50 includes two second restricting portions 52 at one of opposite ends thereof. The second restricting portions 52 are each in a hook-like shape forming a cutaway portion in which the pinching member 28 is fit with the reinforcing member 50 when held by the heater holding member 26. An end surface 54 of the pinching member 28 is in contact with one of the second restricting portions 52 in the cutaway portion. In the above configuration, it is possible for the reinforcing member 50, which includes the second restricting portions 52, to restrict movement of the pinching member 28 in the longitudinal direction P relative to the heater 20 and the heater holding member 26.

In the above configuration, the first restricting portion 48B of the holding member 22 restricts movement of the pinching member 28 in the short direction N as described with reference to FIGS. 4 and 5. Also, the second restricting portions 52 of the reinforcing member 50 restrict movement of the pinching member 28 in the longitudinal direction P as illustrated in FIG. 6. Thus, it is possible that the reinforcing member 50 keeps the pinching member 28 from being detached from the heater 20 and the heater holding member 26. Accordingly, it is possible to prevent the pinching member 28 from falling off of the heater 20 and the heater holding member 26 in the longitudinal direction P. Therefore, it is possible to prevent detachment of particularly the heater 20 from the heater holding member 26 in the longitudinal direction P once the reinforcing member 50 is mounted on the heater holding member 26.

Figure 7:
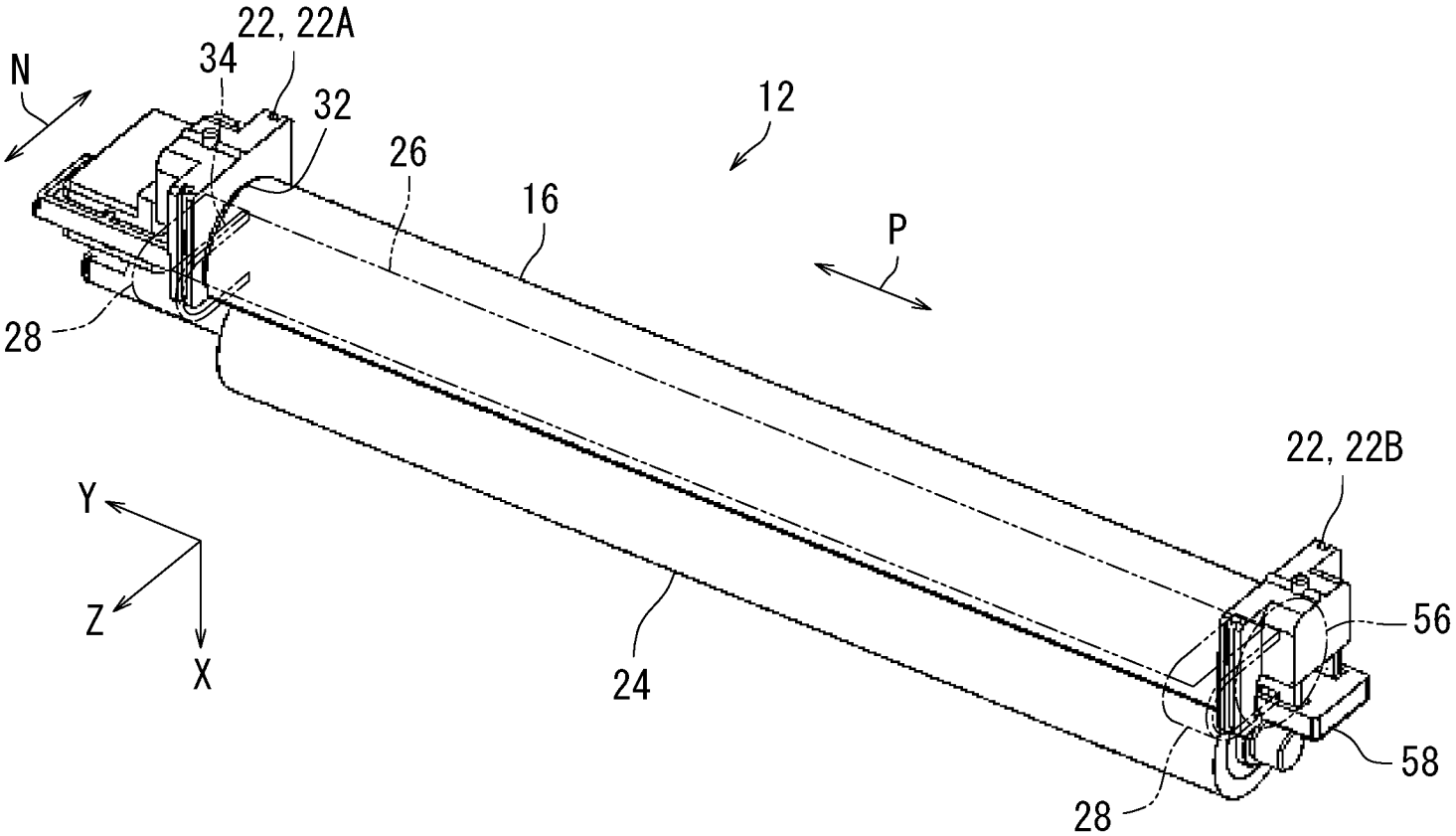
FIG. 7 is another perspective view of the fixing device according to an embodiment as viewed from diagonally above.

The fixing device 12 and the heating section 18 will be described next with reference to FIGS. 3 and 7. FIG. 7 is a perspective view of the fixing device 12 according to an embodiment as viewed from diagonally above.

As illustrated in FIG. 7, the fixing device 12 includes the holding members 22 at each of the opposite ends thereof in the longitudinal direction P. In the following description, one of the holding members 22 may be referred to as a holding member 22A and the other holding member 22 may be referred to as a holding member 22B. The holding member 22A holds the first end 32 of the fixing belt 16 in a slidable manner. The holding member 22B holds a second end 56 of the fixing belt 16, which is the other end of the opposite ends of the fixing belt 16, in a slidable manner.

The reinforcing member 50 of the heating section 18 includes an additional second restricting portion 52 at the other of the opposite ends thereof. Similarly to the second restricting portions 52 at the one end thereof, the second restricting portion 52 at the other end is shaped to form a cutaway portion. An end surface 54 of another pinching member 28 located at the other of the opposite ends of the reinforcing member 50 is in contact with the additional second restricting portion 52 in the cutaway portion. The cutaway portion in the additional second restricting portion 52 at the other end of the reinforcing member 50 has the same configuration and function as the cutaway portion in the one of the second restricting portions 52 at the one end thereof. As a result of the reinforcing member 50 including the second restricting portions 52 at the respective opposite ends thereof, movement of the pinching member 28 relative to the heater 20 and the heater holding member 26 in the longitudinal direction P can be restricted at the opposite ends of the heating section 18. In the above configuration, it is particularly possible to prevent the heater 20 from detaching in the longitudinal direction P from the heater holding member 26 at the opposite ends of the heating section 18 once the reinforcing member 50 is mounted on the heater holding member 26.

The heating section 18 includes a pair of pinching members 28 in the embodiment. The paired pinching members 28 are located at the respective opposite ends of the heating section 18. One of the paired pinching members 28 pinches one end 70 of the heater 20 in the longitudinal direction P and one end 68 of the heater holding member 26 in the longitudinal direction P. The other of the paired pinching members 28 pinches the other end of the heater 20 in the longitudinal direction P and the other end 58 of the heater holding member 26 in the longitudinal direction P. In the above configuration, the heater 20 is more difficult to detach from the heater holding member 26. Thus, it is possible to prevent the heater 20 from falling off of the heater holding member 26.

Figure 8:
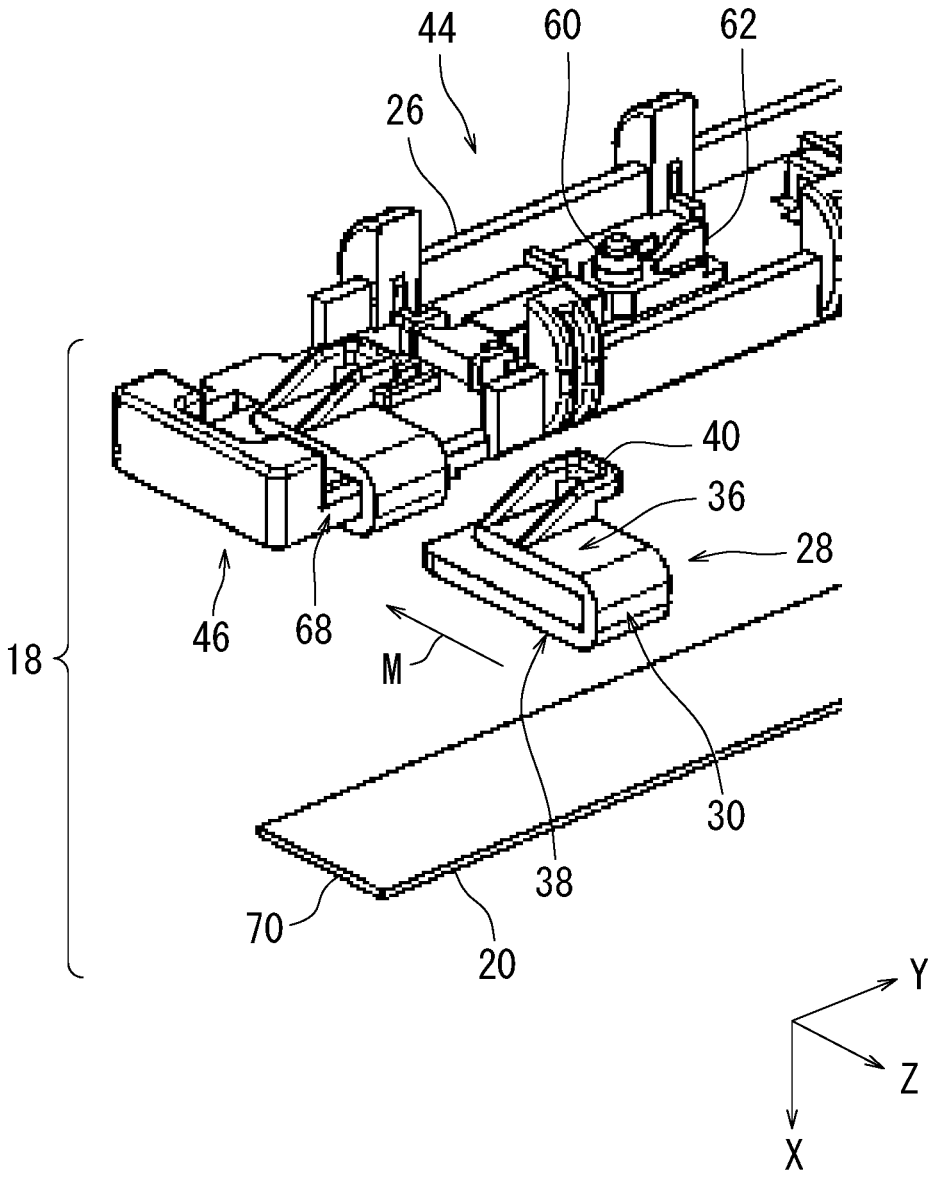
FIG. 8 is a perspective view of the heating section and a pinching member according to an embodiment as viewed from diagonally above.

The heating section 18 and the pinching members 28 will be described next in detail with reference to FIG. 8. FIG. 8 is a perspective view of the heating section 18 and one of the pinching members 28 according to an embodiment as viewed from diagonally above.

As illustrated in FIG. 8, the heating section 18 further includes at least one heat sensitive body 60 and at least one heat sensitive body holding portion 62. The heat sensitive body 60 is disposed opposite to the heater 20 and senses heat of the heater 20. The heat sensitive body 60 detects a temperature of the heater 20 in the present embodiment. The heat sensitive body holding portion 62 holds the heat sensitive body 60. The heat sensitive body holding portion 62 is disposed on an opposite side of the heater holding member 26 from the heater 20. In other words, the heat sensitive body 60 and the heat sensitive body holding portion 62 that holds the heat sensitive body 60 are disposed above the upper surface 44 of the heater holding member 26.

The pinching member 28 before being attached to the heating section 18 and the pinching member 28 having been attached to the heating section 18 are both illustrated in FIG. 8. Therefore, it is not meant that the heating section 18 includes a plurality of pinching members 28 at each end thereof.

The pinching member 28 pinching the heater 20, the heater holding member 26, and the heat sensitive body holding portion 62 restricts movement of the heater 20 and the heat sensitive body holding portion 62 relative to the heater holding member 26. In the above configuration in the present embodiment, it is possible to prevent the heater 20 from falling off of the heater holding member 26 and prevent detachment of the heat sensitive body 60 and the heat sensitive body holding portion 62 from the heater holding member 26.

Figure 9A:
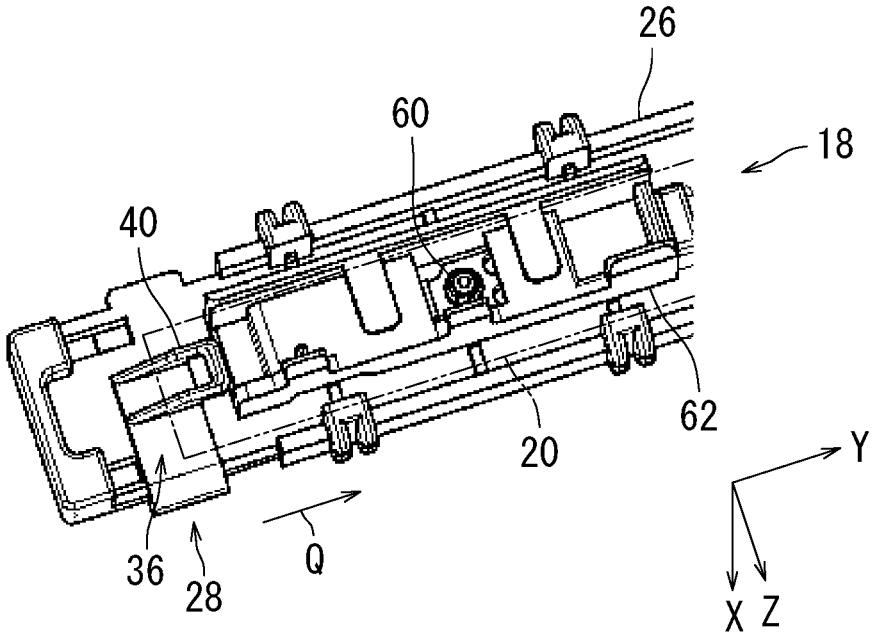
FIG. 9A is a diagram illustrating a state in which the pinching member is attached to a heater holding member according to an embodiment.
Figure 9B:
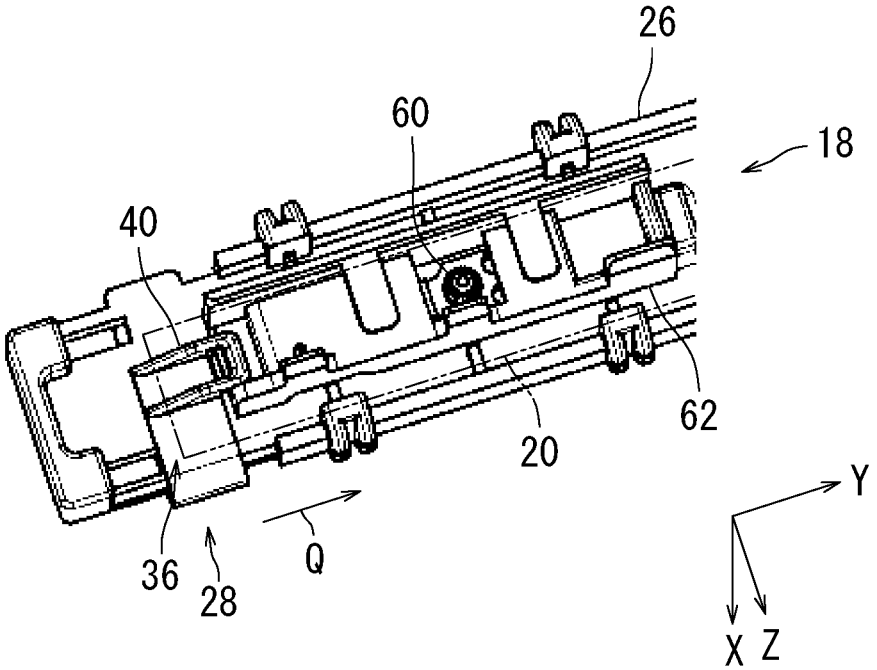
FIG. 9B is a diagram illustrating a state in which the pinching member is attached to the heater holding member and a heat sensitive body holding portion.

The heating section 18 and the pinching member 28 will be described next in detail with reference to FIGS. 9A and 9B. FIG. 9A is a diagram illustrating a state in which the pinching member 28 is attached to the heater holding member 26 in an embodiment. FIG. 9B is a diagram illustrating a state in which the pinching member 28 is attached to the heat sensitive body holding portion 62 in FIG. 9A in addition.

As illustrated in FIG. 9A, the third pinching portion 40 of the pinching member 28 extends from the first pinching portion 36 of the pinching member 28 toward the heat sensitive body holding portion 62 and is in contact with the heat sensitive body holding portion 62. The third pinching portion 40 is in a protruding shape, a claw-like shape, or a hook-like shape. As illustrated in FIG. 9A, an end of the heat sensitive body holding portion 62 located opposite to the pinching member 28 has a recessed portion or a cutaway portion that is in contact with or engages with the third pinching portion 40 of the pinching member 28. As illustrated in FIG. 9B, when the pinching member 28 attached to the heater holding member 26 is moved in a direction Q, the third pinching portion 40 of the pinching member 28 comes in contact with or fitted in the recessed portion or the cutaway portion of the heat sensitive body holding portion 62. The direction Q is a direction from the pinching member 28 to the heat sensitive body holding portion 62 in parallel to the longitudinal direction P. In the above configuration, it is possible that the pinching member 28 keeps the heat sensitive body 60 and the heat sensitive body holding portion 62 holding the heat sensitive body 60 from being detached from the heater holding member 26, thereby preventing the heater 20 from falling off of the heater holding member 26. Furthermore, it is possible that the third pinching portion 40 of the pinching member 28 catches the end of the heat sensitive body holding portion 62 by being in contact therewith, thereby eliminating the need of forming a raised hole in the heater holding member 26. Thus, heating efficiency of the fixing device 12 can be increased.

In addition, the holding members 22 and at least one second restricting portion 52 of the reinforcing member 50 are located at the respective opposite ends of the heating section 18. As a result of the holding member 22 and the second restricting portion 52 of the reinforcing member 50 being located at each of the opposite ends of the heating section 18, the pinching member 28 is difficult to detach from the heater 20 and the heater holding member 26, thereby preventing the pinching member 28 from falling off of the heater 20 and the heater holding member 26 in both the longitudinal direction P and the short direction N. Thus, the heater 20, the heat sensitive body 60, and the heat sensitive body holding portion 62 can be prevented from falling off of the heater holding member 26 in both the longitudinal direction P and the short direction N at each of the opposite ends of the heating section 18 once the holding member 22 and the reinforcing member 50 are mounted on the heater holding member 26.

Figure 10A:
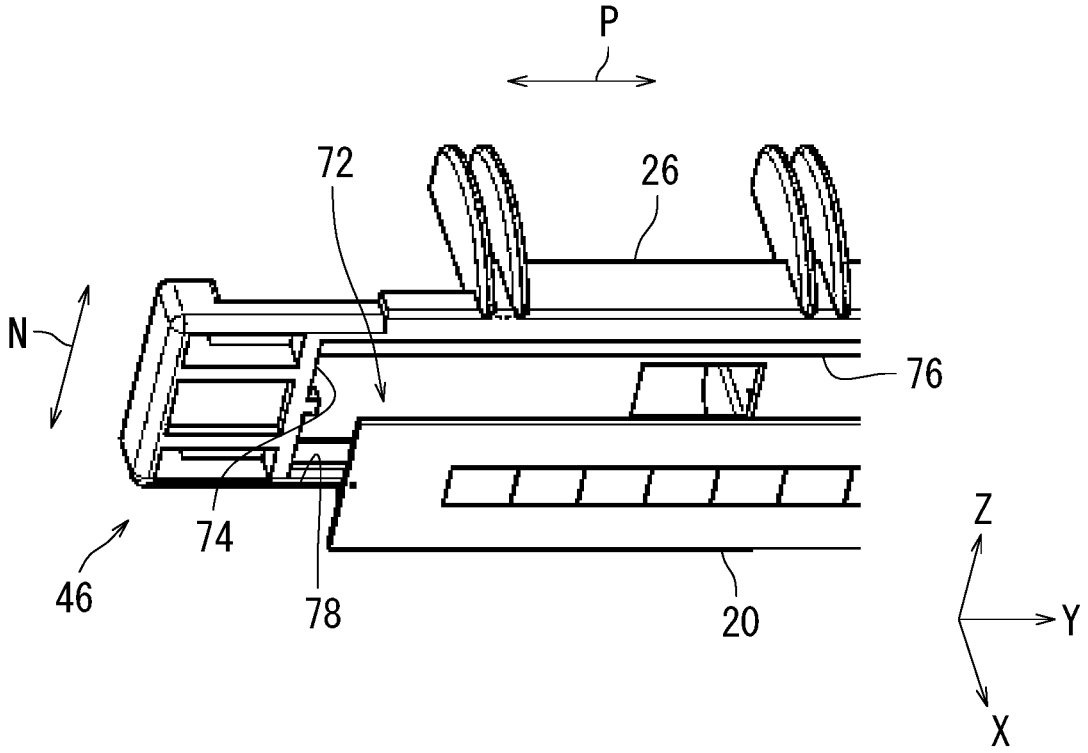
FIG. 10A is a perspective view of a heater and the heater holding member according to an embodiment as viewed from diagonally below.
Figure 10B:
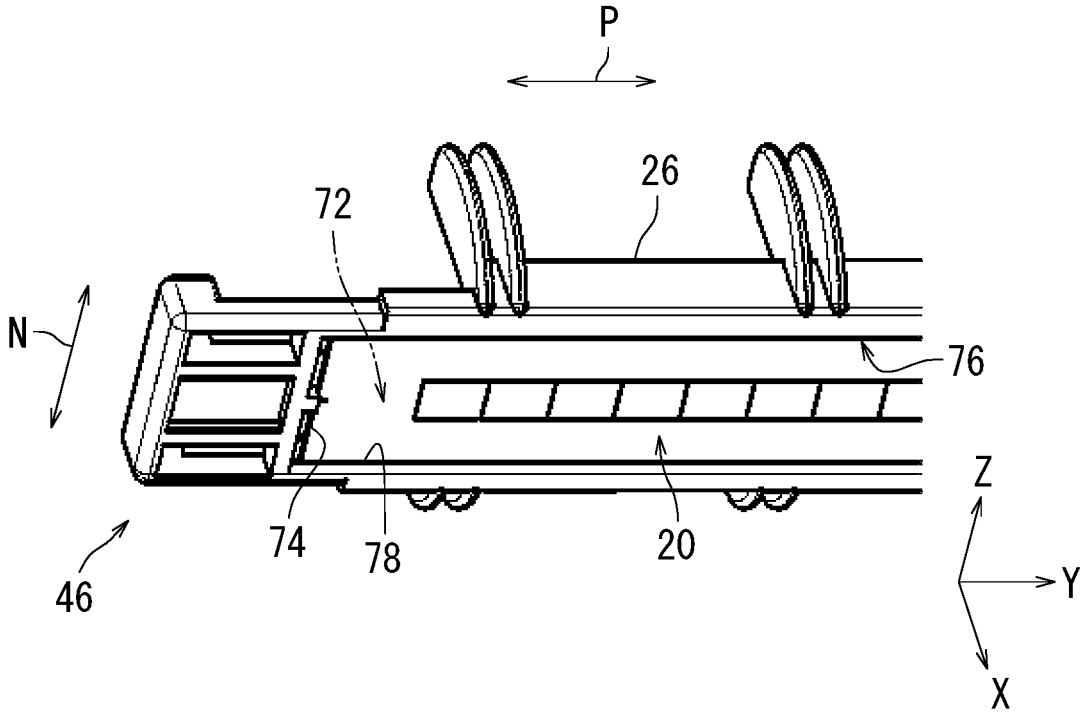
FIG. 10B is a perspective view of a state in which the heater is attached to the heater holding member as viewed from diagonally below.

The heater 20 and the heater holding member 26 will be described next with reference to FIGS. 9A to 10B. FIG. 10A is a perspective view of the heater 20 and the heater holding member 26 according to an embodiment as viewed from diagonally below. FIG. 10B is a perspective view of a state in which the heater 20 in FIG. 10A is attached to the heater holding member 26, as viewed from diagonally below.

As illustrated in FIG. 10A, the heater holding member 26 includes a heater receiving portion 72. The heater receiving portion 72 is located on the lower surface 46 of the heater holding member 26. The heater receiving portion 72 has an end 74, an end 76, and an end 78. The end 78 and the end 76 are located on respective sides of the lower surface 46 of the heater holding member 26 in the short direction N. The end 74 is located on one of opposite sides of the lower surface 46 of the heater holding member 26 in the longitudinal direction P. The heater receiving portion 72 may have another end that is located on the other side of the lower surface 46 of the heater holding member 26 in the longitudinal direction P.

As illustrated in FIG. 10B, movement of the heater 20 attached to the heater receiving portion 72 in both the longitudinal direction P and the short direction N is restricted by the end 74, the end 76, and the end 78 of the heater receiving portion 72. Furthermore, as a result of the pinching member 28 in FIG. 9B being attached to the heater 20 and the heater holding member 26 in FIG. 10B, upward and downward movement of the heater 20 and the heater holding member 26 is restricted. Thus, the heater 20 is difficult to detach from the heater holding member 26, thereby preventing the pinching member 28 from falling off of the heater 20 and the heater holding member 26.

Figure 11:
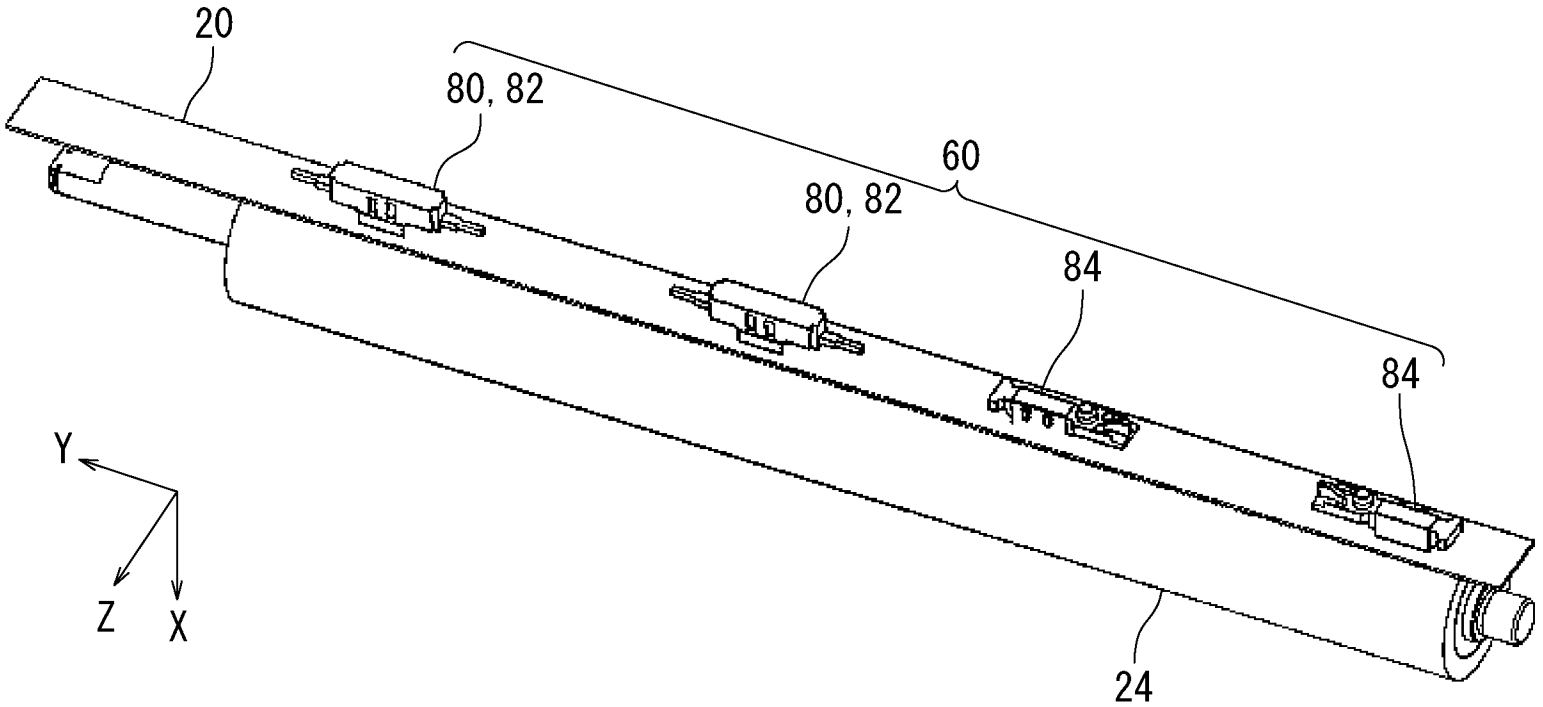
FIG. 11 is a perspective view of the heater and heat sensitive bodies according to an embodiment as viewed from diagonally above.

The heat sensitive body 60 will be described next with reference to FIGS. 2 and 11. FIG. 11 is a perspective view of the heater 20 and heat sensitive bodies 60 according to an embodiment, as viewed from diagonally above. FIG. 11 illustrates the heater 20, the heat sensitive bodies 60, and the pressure member 24 in the fixing device 12 in FIG. 2.

As illustrated in FIG. 11, in a configuration in which the heating section 18 includes a plurality of heat sensitive bodies 60 (four heat sensitive bodies 60 in FIG. 11), for example, two of the heat sensitive bodies 60 are each a thermal fuse 80 or a thermostat 82 and the other two of the heat sensitive bodies 60 are each a thermistor 84. Thus, the heat sensitive bodies 60 include at least one of the thermal fuse 80, the thermostat 82, and the thermistor 84. The thermal fuse 80 is a protection element such as a one-shot thermostat. The thermal fuse 80 shuts off electric power supply to the heater 20 when the temperature of the heater 20 is equal to or higher than a first threshold. In particular, once the thermal fuse 80 shuts off the electric power supply according to the temperature of the heater 20, the electric power supply is not resumed. Therefore, accuracy in suspending heating of the fixing belt 16 by the heater 20 when the temperature of the heater 20 is excessively increased can be improved.

The thermostat 82 shuts off the electric power supply to the heater 20 when the temperature of the heater 20 is equal to or higher than a second threshold, and causes the electric power supply to the heater 20 to be resumed when the temperature of the heater 20 becomes lower than the second threshold. In the above configuration, the heater 20 for heating the fixing belt 16 can be turned on and off with delicate accuracy corresponding to temperature change of the heater 20.

The thermistor 84 is a semiconductor element for measuring the temperature of the heater 20. The image forming apparatus 2 controls the heater 20 according to the temperature measured by the thermistor 84. As a result of some of the heat sensitive bodies 60 each being the thermistor 84, accuracy in controlling the temperature of the heater 20 can be improved.

Embodiments of the present disclosure have been described so far with reference to the accompanying drawings. However, the present disclosure is not limited to the above-described embodiments and can be practiced in various ways within the scope without departing from the essence of the present disclosure. Elements of configuration disclosed in the above embodiments can be combined as appropriate in various different forms. For example, some of the elements of configuration may be omitted among all of the elements of configuration described in the embodiments. Alternatively or additionally, elements of configuration described in different embodiments may be combined as appropriate. The drawings are schematic illustrations that emphasize elements of configuration in order to facilitate understanding thereof, and the thickness, length, numbers, distance, and so on of each element of configuration illustrated in the drawings may differ from actual ones thereof in order to facilitate preparation of the drawings. The materials, shape, dimension, and so on of each element of configuration shown in the above-described embodiments are merely examples that do not impart any particular limitations and may be altered in various ways, so long as such alterations do not substantially deviate from the configuration of the present disclosure.

What is claimed is:

1. A fixing device comprising:

a fixing belt; and a heating section disposed opposite to an inner circumferential surface of the fixing belt, wherein the heating section includes:

a heater that heats the fixing belt;

a heater holding member that holds the heater; and a pinching member that pinches the heater and the heater holding member to restrict movement of the heater relative to the heater holding member, the heater extends in a direction parallel to a rotation axis of the fixing belt, the pinching member includes:

a first pinching portion in contact with the heater holding member on an opposite side of the heater holding member to the heater;

a second pinching portion in contact with the heater underneath the heater; and a joint portion that connects the first pinching portion to the second pinching portion, the pinching member pinches the heater and the heater holding member from a side of a rim of the heater extending in a longitudinal direction of the heater, the fixing device further comprises a holding member configured to hold an end of the fixing belt and an end of the heater holding member, and the holding member includes a first restricting portion that restricts movement of the pinching member in a short direction of the heater relative to the heater and the heater holding member.

2. The fixing device according to claim 1, wherein the heating section further includes a reinforcing member that reinforces the heater holding member, and the reinforcing member includes a second restricting portion that restricts movement of the pinching member in the longitudinal direction of the heater relative to the heater and the heater holding member.

3. The fixing device according to claim 1, wherein the heating section includes, as the pinching member, a pair of pinching members, one pinching member of the pair of pinching members pinches one end of the heater in the longitudinal direction of the heater and one end of the heater holding member in the longitudinal direction of the heater holding member, and another pinching member of the pair of pinching members pinches another end of the heater in the longitudinal direction of the heater and another end of the heater holding member in the longitudinal direction of the heater holding member.

4. The fixing device according to claim 1, wherein the heating section further includes:

a heat sensitive body that is disposed opposite to the heater and that senses heat of the heater; and a heat sensitive body holding portion that holds the heat sensitive body, the heat sensitive body holding portion is disposed on an opposite side of the heater holding member to the heater, and the pinching member restricts movement of the heater and the heat sensitive body holding portion relative to the heater holding member by pinching the heater, the heater holding member, and the heat sensitive body holding portion.

5. The fixing device according to claim 4, wherein the pinching member further includes a third pinching portion that extends from the first pinching portion toward the heat sensitive body holding portion and that is in contact with the heat sensitive body holding portion.

6. The fixing device according to claim 4, wherein the heat sensitive body includes at least one of a thermal fuse, a thermostat, and a thermistor, the thermal fuse shuts off electric power supply to the heater when a temperature of the heater is equal to or higher than a first threshold value, the thermostat shuts off the electric power supply to the heater when the temperature of the heater is equal to or higher than a second threshold, and causes the electric power supply to the heater to be resumed when the temperature of the heater becomes lower than the second threshold, and the thermistor measures the temperature of the heater.

7. An image forming apparatus comprising:

the fixing device according to claim 1; and an image forming section configured to form a toner image on a sheet, wherein the fixing device fixes the toner image to the sheet.

8. A fixing device comprising:

a fixing belt; and a heating section disposed opposite to an inner circumferential surface of the fixing belt, wherein the heating section includes:

a heater that heats the fixing belt;

a heater holding member that holds the heater; and a pinching member that pinches the heater and the heater holding member to restrict movement of the heater relative to the heater holding member, the heater extends in a direction parallel to a rotation axis of the fixing belt, the pinching member includes:

a first pinching portion in contact with the heater holding member on an opposite side of the heater holding member to the heater;

a second pinching portion in contact with the heater underneath the heater; and a joint portion that connects the first pinching portion to the second pinching portion, the pinching member pinches the heater and the heater holding member from a side of a rim of the heater extending in a longitudinal direction of the heater, the heating section further includes:

a heat sensitive body that is disposed opposite to the heater and that senses heat of the heater; and a heat sensitive body holding portion that holds the heat sensitive body, the heat sensitive body holding portion is disposed on an opposite side of the heater holding member to the heater, the pinching member restricts movement of the heater and the heat sensitive body holding portion relative to the heater holding member by pinching the heater, the heater holding member, and the heat sensitive body holding portion, and the pinching member further includes a third pinching portion that extends from the first pinching portion toward the heat sensitive body holding portion and that is in contact with the heat sensitive body holding portion.

9. The fixing device according to claim 8, wherein the heat sensitive body includes at least one of a thermal fuse, a thermostat, and a thermistor, the thermal fuse shuts off electric power supply to the heater when a temperature of the heater is equal to or higher than a first threshold value, the thermostat shuts off the electric power supply to the heater when the temperature of the heater is equal to or higher than a second threshold, and causes the electric power supply to the heater to be resumed when the temperature of the heater becomes lower than the second threshold, and the thermistor measures the temperature of the heater.

10. An image forming apparatus comprising:

the fixing device according to claim 8; and an image forming section configured to form a toner image on a sheet, wherein the fixing device fixes the toner image to the sheet.

* * * * *